US005947215A

United States Patent [19]

Lundell

[11] Patent Number: 5,947,215

[45] Date of Patent: Sep. 7, 1999

[54] DIAMOND ENHANCED ROCK DRILL BIT FOR PERCUSSIVE DRILLING

[75] Inventor: Lars-Gunnar Lundell, Sandviken, Sweden

[73] Assignee: Sandvik AB, Sandviken, Sweden

[21] Appl. No.: 08/965,110

[22] Filed: Nov. 6, 1997

[51] Int. Cl.[6] ..... E21B 10/56

[52] U.S. Cl. ..... 175/417; 175/420.2; 175/426

[58] Field of Search ..... 175/426, 420.1, 175/417, 420.2, 418, 414

[56] References Cited

U.S. PATENT DOCUMENTS

| | | | |
|---|---|---|---|
| 2,725,216 | 11/1955 | Brown | 175/389 |
| 3,519,092 | 7/1970 | Miller | 175/426 |
| 3,997,011 | 12/1976 | Staroba | 175/400 |
| 4,296,825 | 10/1981 | Larsson | 175/417 |
| 4,304,312 | 12/1981 | Larsson | 175/400 |
| 4,572,307 | 2/1986 | Tunell | 175/417 |
| 4,598,779 | 7/1986 | Liljekvist et al. | 175/413 |
| 4,607,712 | 8/1986 | Larsson | 175/414 X |
| 4,716,976 | 1/1988 | Isakov | 175/415 |
| 5,029,657 | 7/1991 | Mahar et al. | 175/393 |
| 5,379,854 | 1/1995 | Dennis | 175/434 |
| 5,794,728 | 8/1998 | Palmberg | 175/400 |

*Primary Examiner*—Hoang C. Dang
*Attorney, Agent, or Firm*—Burns, Doane, Swecker & Mathis, L.L.P.

[57] ABSTRACT

A rock drill bit for percussive drilling includes a steel body in which six gauge buttons and a single front button are mounted. The gauge buttons are arranged symmetrically and equally spaced about a central axis of the bit. The front button is arranged along the central axis. The front button is of larger diameter than the gauge button. At least three of the gauge buttons are diamond-enhanced, and the front button may be diamond-enhanced.

17 Claims, 2 Drawing Sheets

DIAMOND ENHANCED ROCK DRILL BIT FOR PERCUSSIVE DRILLING

TECHNICAL BACKGROUND AND PRIOR ART

The present invention relates to rock drilling and to drill bits therefor.

Larsson U.S. Pat. No. 4,607,712 discloses a rock drill bit of the impact type for top hammer drilling comprising a cylindrical body and a front surface provided with fixed peripherally spaced buttons and a central button. Normally such a conventional drill bit drills about 30 m before regrinding is necessary.

To improve such drilling performance it has been proposed to use diamond enhance bits for top hammer drilling. The results, however, have not been competitive compared to conventional cemented carbide insert bits. Diamond enhanced button bits might be most useful in hard to extra hard abrasive rock where diamond enhanced button bits have the advantage that they do not need to be reground, whereas conventional cemented carbide buttons wear more rapidly and thus need to be reground more frequently. Other advantages with diamond-enhanced bits are: even hole dimension, even penetration rate, less down time due to less frequent changing of bits, etc. Previous diamond-enhanced bits for top hammer drilling have often had about the same life-span as conventional cemented carbide bits.

However, bad utilization of the bits due to asymmetrical location of the diamond-enhanced buttons results in heavy wear of one or two gauge buttons that are more subjected to more load than the others. The life of such heavily wearing gauge buttons constitutes the effective life of the bit. One way to make the diamond-enhanced bits more competitive is therefore to place the gauge buttons symmetrically at the same distance around the bit periphery. The potential when placing the gauge buttons symmetrically at the same distance between each other is (from the wear point of view) judged to be about double the life span of a conventional cemented carbide-button or cemented carbide insert-bit (when drilling in hard to hard abrasive rock). A diamond-enhanced button comprises a cemented carbide button substrate with a PCD-layer (poly crystalline diamond) on the tip of the substrate.

SUMMARY OF THE INVENTION

To minimize or eliminate the above-noted shortcomings, the present invention involves a rock drill adapted for use in percussive drilling. The drill comprises a bit body, and a plurality of identically sized gauge buttons, six in total number, mounted substantially symmetrically at substantially equal distances from one another around an outer periphery of the bit body. At least three of the gauge buttons are diamond-enhanced. The drill further comprises a front button, one in total number, mounted in a front face of the bit body. The front button, which may be diamond-enhanced, extends along a central axis of the bit body. The front button is of larger diameter than the gauge buttons.

Preferably, the smallest distance between adjacent gauge buttons is at least 2.5 mm. The smallest distance between the front button and any gauge button is preferably at least 2.5 mm.

The front button can be mounted in a recess formed in the front face, whereby the front button lies substantially in a plane in which forwardmost portions of the gauge buttons lie. Alternatively, the front button could project forwardly beyond that plane.

BRIEF DESCRIPTION OF THE DRAWING

The objects and advantages of the invention will become apparent from the following detailed description of preferred embodiments thereof in connection with the accompanying drawing in which like numerals designate like elements and in which.

DETAILED DESCRIPTION OF THE PREFERRED EMBODIMENTS OF THE INVENTION

A bit 10 comprises a steel bit body 12 with six identically-sized gauge buttons 14 and one front button 16. At least three, but preferably all of the gauge buttons are diamond-enhanced. If only three of the gauge inserts are diamond-enhanced, those three diamond-enhanced buttons will preferably be spaced apart by 120°. The front button 16 is preferably diamond-enhanced, but not necessarily so. By "diamond-enhanced button" is meant a button having a cylindrical cemented carbide base and a cemented carbide tip (preferably of semi-spherical shape), and a layer of diamond (e.g. PCD) disposed on the tip. If a button is not diamond-enhanced, then only the cemented carbide will engage the rock. The gauge buttons are shorter than conventional buttons in that the mean relation between the length L of the cylindrical part of the button and the diameter D thereof is less than for standard buttons. That is, L/D is in the range of 0.5 standard buttons. That is, L/D is in the range of 0.5 to 0.8 as compared to a conventional range of 0.8 to 1.4. As a result, the steel body will be more rigid.

Figure 1:
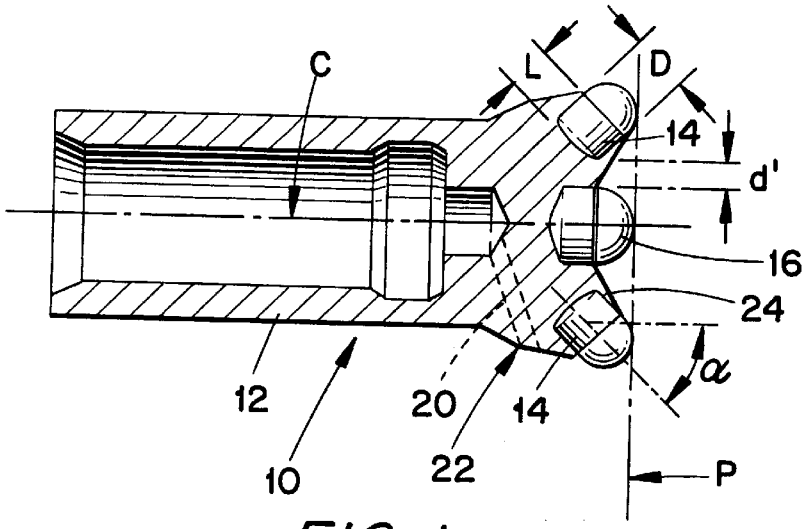
FIG. 1 is a longitudinal sectional view taken through a drill bit accord to a first embodiment of the invention.
Figure 2:
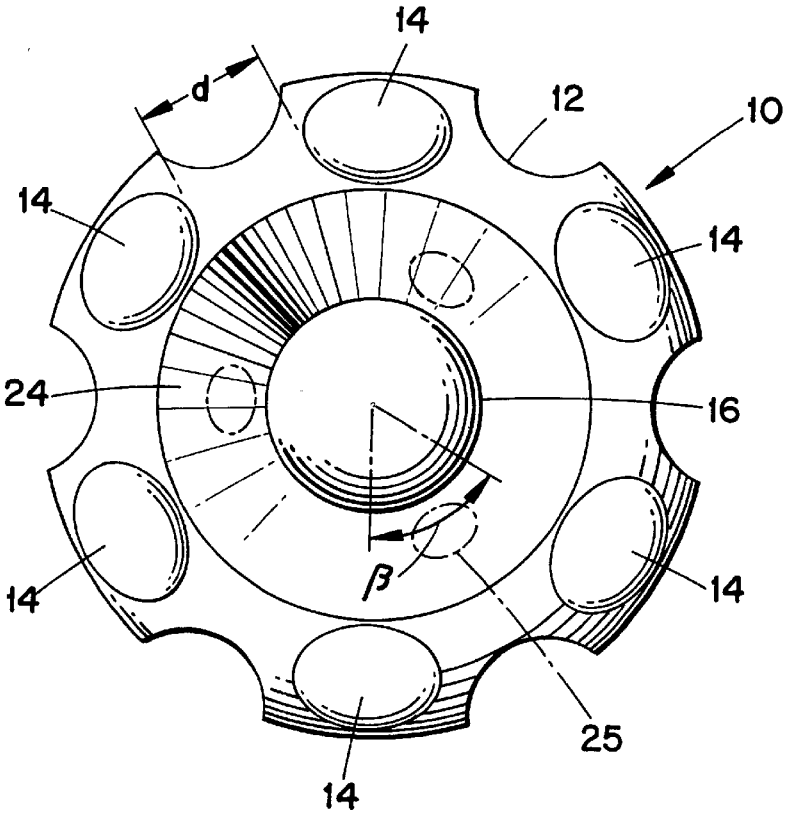
FIG. 2 is a front end view of the drill depicted in FIG. 1.

The inclination $\alpha$ of the gauge buttons relative to a center axis C of the bit is between 50 and 30°, more preferably between 45 to 30° and most preferably about 35°. The gauge buttons are placed with equal distance around the periphery (i.e. spaced apart by an angle $\beta$ of 60°), and are arranged so that the closest distance d between the gauge buttons 14 is not less than 2.5 mm (see FIG. 2). The closest distance d' between the front button 16 and any gauge button 14 is not less than 2.5 mm (see FIG. 1). Flushing hole(s) 20 are provided and can have their exit on the side periphery (as shown) or in the front face (as shown in phantom lines 25 n FIG. 2). The diameter of flushing hole(s) 20 is at least 2.5 mm on a bit diameter of 50 mm. The skirt 22 of the bit can either be as shown or have guide wings such as are used in retrac bits or guide bits.

The front button 16 is of larger diameter than the gauge buttons in order to provide for good straight-ahead guiding of the bit. The front button 16 is located in a recess 24 of the front face, whereby the forwardmost portions of the gauge buttons 14 and front button 16 lie in a common plane P oriented perpendicular to the center axis C.

The buttons 14, 16 are either press-fit or shrink-fit into the bit body 12.

A bit built and tested according to the present invention had a diameter of 50 mm. Six identical diamond-enhanced gauge buttons 14 having a diameter D of 12 mm and a length L of 13.8 mm were symmetrically mounted about the axis C of a steel bit body 12 at equal circumferential spacing.

A single diamond-enhanced front button 16 disposed on the axis C was employed, that button having a diameter of 16 mm.

The angle of inclination α of the gauge buttons was 35°. The buttons 14, 16 projected from the hole such that the diamond (PCD) layer of each button was spaced by a distance of about 1 mm from its respective hole in the steel body 12. In a drilling operation, the test bit according to the invention drilled more than 270 m, as compared to only 130 m for a conventional drill (subjected to numerous regrindings) in similar material.

Figure 3:
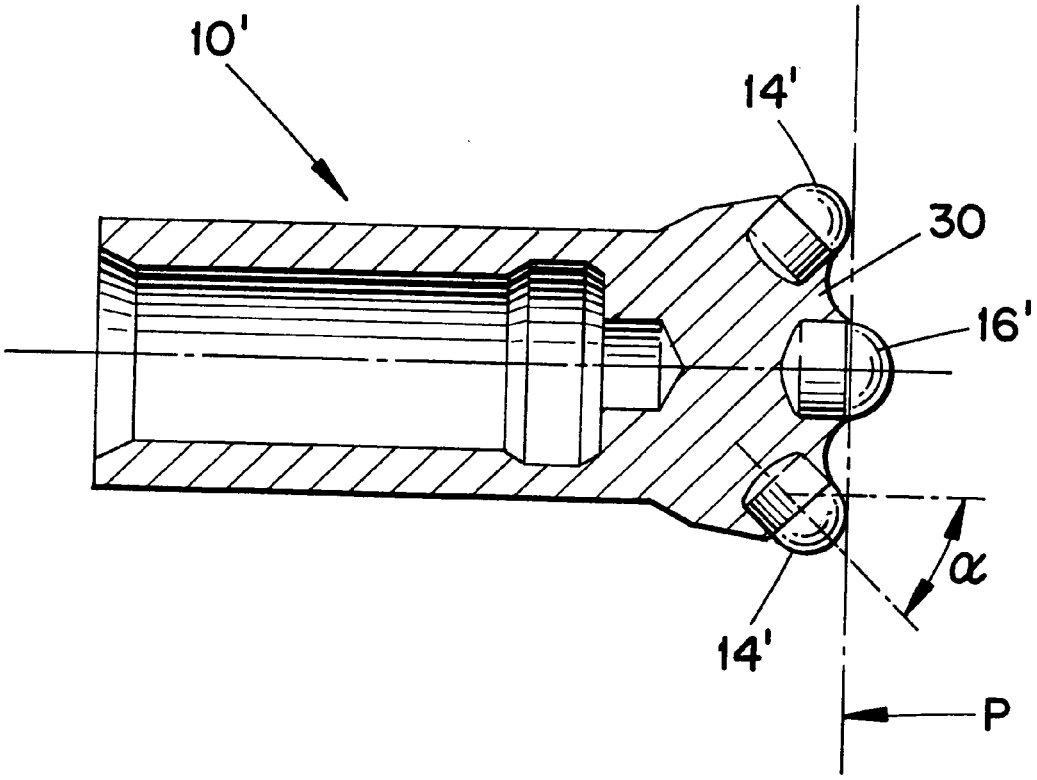
FIG. 3 is a longitudinal sectional view taken through a drill bit according to a second embodiment of the invention.

A second embodiment of a bit 10' according to the invention is depicted in FIG. 3. That bit 10' is the same as that of FIGS. 1 and 2, except that the front button 16' projects forwardly past the plane P in which the forwardmost portions of the gauge buttons 14' lie. That is, the front button 16' is not mounted in a recess of the front face of the bit body, but rather is mounted in a solid steel portion 30 of the bit body which projects forwardly of an outer edge of the bit body.

The bit according to the present invention is ideally suited to top hammer percussive drilling, but can also be used in any other type of percussive drilling such as drifter drilling and long hole drilling, in very abrasive rock.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A rock drill adapted for use in percussive drilling, comprising:

a bit body;

a plurality of identically-sized gauge buttons, six in total number, mounted substantially symmetrically at substantially equal distances from one another around an outer periphery of the bit body, at least three of the gauge buttons being diamond-enhanced; and a front button, one in total number, mounted in a front face of the bit body, the front button extending along a central axis of the bit body, and being of larger diameter than the gauge buttons.

2. The drill bit according to claim 1 wherein all of the gauge buttons are diamond-enhanced.

3. The drill bit according to claim 2 wherein the front button is diamond-enhanced.

4. The drill bit according to claim 1 wherein the front button is diamond-enhanced.

5. The drill bit according to claim 1 wherein the smallest distance between adjacent gauge buttons is at least 2.5 mm.

6. The drill bit according to claim 5 wherein the smallest distance between the front button and any gauge button is at least 2.5 mm.

7. The drill bit according to claim 6 wherein the front button is mounted in a recess formed in the front face, whereby the front button lies substantially in a plane in which forwardmost portions of the gauge buttons lie.

8. The drill bit according to claim 6 wherein the front button projects forwardly beyond a plane in which forwardmost portions of the gauge buttons lie.

9. The drill bit according to claim 1 wherein the smallest distance between the front button and any gauge button is at least 2.5 mm.

10. The drill bit according to claim 1 wherein the front button is mounted in a recess formed in the front face, whereby the front button lies substantially in a plane in which forwardmost portions of the gauge buttons lie.

11. The drill bit according to claim 1 wherein the front button projects forwardly beyond a plane in which forwardmost portions of the gauge buttons lie.

12. The drill bit according to claim 1 wherein the gauge buttons and front button are mounted in the bit body by a press fit.

13. The drill bit according to claim 1 wherein the gauge buttons and front button are mounted in the bit body by a shrink fit.

14. The drill bit according to claim 1 wherein the bit body includes a flushing hole leading from a center of the bit body to an exit on an outer surface thereof, the flushing hole having a diameter of at least 2.5 mm.

15. The drill bit according to claim 11 wherein no gauge button lies closer than 2.5 mm to the flushing hole exit.

16. The drill bit according to claim 1 wherein the bit body is formed of steel.

17. The drill bit according to claim 1 wherein each of the gauge buttons comprises a cylindrical portion and a substantially semi-spherical front portion, a ratio of length-to-diameter of each gauge button is less than 0.8.

* * * * *